United States Patent [19]

Allen

[11] Patent Number: 4,542,824

[45] Date of Patent: Sep. 24, 1985

[54] HANG-UP GARMENT BAG

[75] Inventor: James H. Allen, Covington, Ky.

[73] Assignee: 'totes' incorporated, Loveland, Ohio

[21] Appl. No.: 612,031

[22] Filed: May 18, 1984

[51] Int. Cl.[4] ..... B65D 85/18

[52] U.S. Cl. ..... 206/287.1; 383/38; 383/41; 383/66; 190/111

[58] Field of Search ..... 206/287.1, 287; 383/38, 383/41, 66; 190/111

[56] References Cited

U.S. PATENT DOCUMENTS

| | | | |
|---|---|---|---|
| 2,025,101 | 12/1935 | Halpin | 190/111 |
| 2,154,630 | 4/1939 | Marbury et al. | 206/287.1 |
| 2,606,636 | 8/1952 | Braverman | 206/287 |
| 2,609,897 | 9/1952 | Meyer | 190/111 |
| 2,918,997 | 12/1959 | Kotkins | 190/111 |
| 2,964,149 | 12/1960 | Smallberg | 190/111 |
| 3,115,959 | 12/1963 | Jaffe | 206/287.1 |
| 3,315,772 | 4/1967 | Katz | 206/287.1 |
| 3,512,621 | 5/1970 | Teetor | 206/287 |
| 3,831,740 | 8/1974 | Pendergast et al. | 206/287 |
| 3,838,758 | 10/1974 | Brown | 383/38 |
| 4,378,866 | 4/1983 | Pelavin | 190/111 |

*Primary Examiner*—Stephen P. Garbe

*Attorney, Agent, or Firm*—Wood, Herron & Evans

[57] ABSTRACT

A novel soft luggage type hang-up garment bag that includes two major interior compartments having a width and length substantially equal to the width and length of the bag, and two minor interior compartments each having a width about one-half the width of the bag and a length no greater than about one-half the length of the bag, when the bag is in hang-up configuration. The bag is provided with a single width peripheral gusset wall that interconnects the bag's two major sidewalls so that all the major and minor compartments are interiorly of those sidewalls. The bag also is provided with a novel hang-up hook that is retractable into the bag's interior when the bag is being carried, and that is extendable from an end section of the bag's peripheral gusset wall to hang-up the bag.

9 Claims, 7 Drawing Figures

HANG-UP GARMENT BAG

This invention relates to hang-up garment bags. More particularly, this invention relates to hang-up garment bags of the soft luggage type.

Hang-up garment bags are, of course, very well known to the prior art. The hang-up garment bag is a bag basically comprised of opposed large sidewalls connected by means of a peripheral gusset wall, the sidewalls being of generally rectangular configuration when the bag is in the hang-up configuration, and the length of the sidewalls being about twice as great as the width of the sidewalls in the hang-up configuration. The hang-up garment bag is structured to fold along a fold line normal to the bag's longitudinal axis so that the bag, is in the general size and configuration of a regular suitcase as it is carried during traveling. These types of prior art hang-up garment bags are sized to permit men's suits and ladies' dresses to be stored therein so that when the bag is in the hang-up configuration the suitcoats and dresses hang similar to the way they would hang in the owner's clothes cupboard. It is also known to the prior art to provide the hang-up garment with a hook at one end so that the bag can be hung on a door or on a cupboard rod in its hang-up position.

While hang-up garment bags are well known to the prior art, that type bag often provides only a single interior compartment that has a length and width of the bag in the bag's hang-up position. It is known in the prior art to provide smaller compartments on the exterior of one of the hang-up garment bag's main sidewalls, but this simply adds to the bulkiness of the garment bag which, in turn, detracts from its portability or easy handling while it is being carried. Accordingly, it has been one objective of this invention to provide an improved hang-up garment bag which has a plural number of interior compartments in a bag having two major sidewalls connected with a peripheral gusset wall where no compartment extends exteriorly of those major sidewalls, the two major sidewalls defining the width and length of the garment bag in its hang-up configuration. In this regard, four interior compartments are established by the unique structure of the hang-up garment bag of this invention. Two of these compartments are of a length and width equal to the length and width of the garment bag in the hang-up position, and two of the compartments are of a width about one-half the width of the garment bag, and of a length less than about one-half the length of the garment bag, as that bag is viewed in its hang-up position. Three of these compartments, in preferred form, are accessible through the same major sidewall of the garment bag by means of separate slide fasteners that form a cross-like configuration on that one side of the garment bag.

Another problem with hang-up garment bags of the prior art is with the hook by which same are hung up on a closet rod or over the top of a door. The bag's hang-up hook preferably should be stored in some fashion while the bag is being carried so that that hook does not flop around. It is known to the prior art to store the hook on an end gusset wall of the bag. But this is not completely desirable since the hook can still break loose to flop around while the folded bag is being handled. Accordingly, another objective of this invention has been to provide an improved hang-up hook for a hang-up type garment bag. In accord with this aspect of the invention, the bag's hook is extendable and retractable on an axis parallel to the longitudinal axis of the bag when it is hung up. The main leg of the hook, as well as the nose leg of the hook, are retractable entirely into the bag when desired so that the hook cannot be caught inadvertently on the user's clothing or otherwise while the bag is being carried.

Other objectives and advantages of this invention will be more apparent from the following detailed description taken in conjunction with the drawings in which.

A hang-up garment bag 10 in accord with the principles of this invention is preferably of the soft luggage type. That is, all walls and compartments of the garment bag 10 are made of a flexible material, e.g., cloth, that provides the bag with no rigid wall panels (except as otherwise noted below) throughout the length L and width W of the bag. As described herein, and unless otherwise noted, the description of the garment bag 10 shall be taken with reference to the bag in its hang-up position shown in FIG. 1. The hang-up garment bag 10 has two use positions, only the hang-up position being the one use position shown in the figures and, particularly, in FIG. 1. The other use position of the hang-up garment bag 10 is the carrying or folded position (not shown). The carrying position of the hang-up garment bag 10 is created simply by folding the garment bag in half on a phantom fold line 11 normal to the longitudinal axis 12 of the bag until the two bag handles 13, 14 are juxtaposed one with the other.

Figure 4:
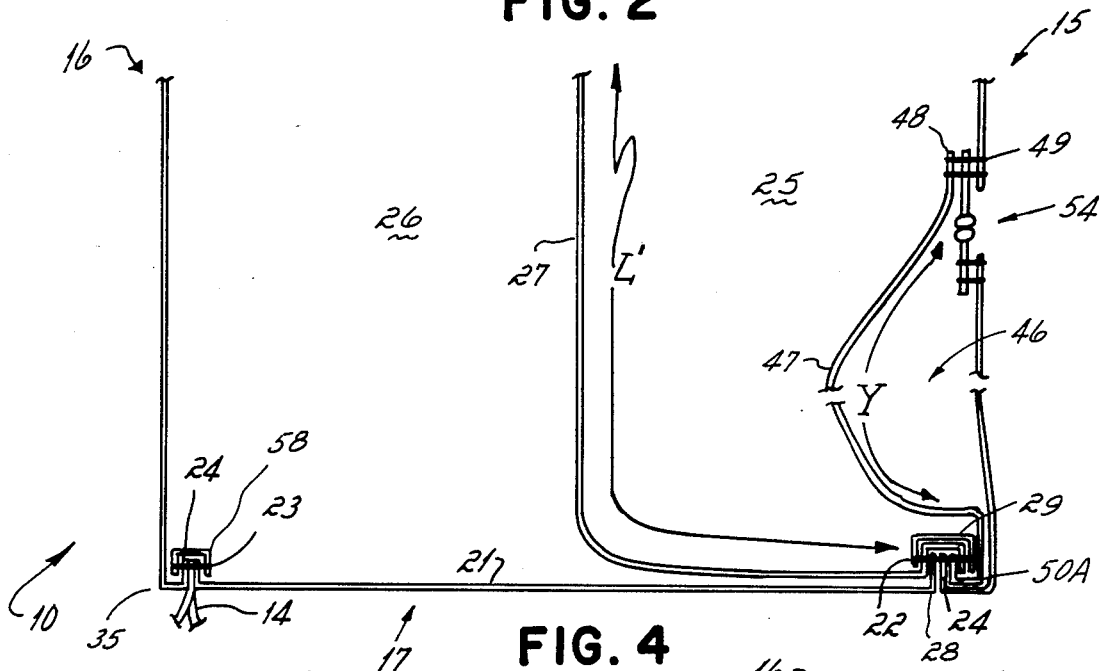
FIG. 4 is a cross-sectional view taken along lines 4—4 of FIG. 1.
Figure 5:
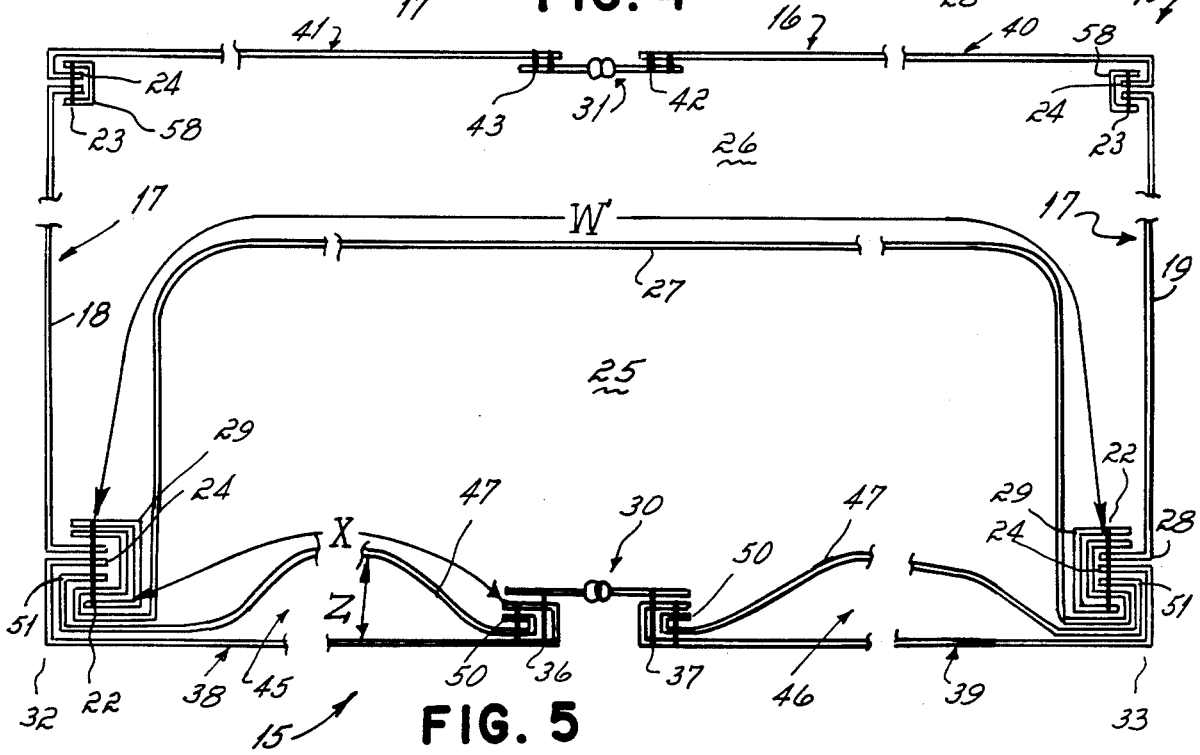
FIG. 5 is a cross-sectional view taken along lines 5—5 of FIG. 1.

The hang-up garment bag 10 is basically comprised of first 15 and second 16 major sidewalls spaced one from the other a distance D, those sidewalls being generally parallel one with the other when the bag is in the hang-up position. These major sidewalls 15, 16 are interconnected one with the other by a peripheral gusset wall 17 that extends completely around the generally rectangular periphery established by the two major sidewalls. The gusset wall 17 is comprised of side sections 18, 19 and end sections 20, 21. Note particularly that the length L of the garment bag in the hang-up position is about twice as great as the width W of the garment bag, i.e., the length of each major sidewall 15, 16 is about twice as great as its width. Each major sidewall 15, 16 is attached to the peripheral gusset wall 17 along a peripheral stitch line 22, 23, respectively. The selvage or edges 24 of the adjacent major sidewalls and gusset wall are covered by binding tape 29, 58 with the stitch lines 22, 23 being disposed interiorly of the garment bag as shown in FIGS. 4 and 5.

The interior of the hang-up garment bag 10 includes two major compartments 25, 26, each of which is sized, from length and width standpoints, substantially equal to the length L and width W of the garment bag when viewed in the hang-up position. The two major interior compartments 25, 26 are divided one from the other by an interior divider wall 27 that is of a length L' and width W' somewhat greater than the length L and width W of the garment bag's major sidewalls. This for the reason that the length L' and width W' of the interior divider wall 27 is such as to provide depth D', D'' to the interior compartments 25, 26 when the interior divider wall is stitched to the peripheral edge 28 of the bag's peripheral gusset wall 17. In this regard, the interior divider wall 27, as shown particularly in FIGS. 4 and 5, is connected to the garment bag 10 along substantially the same stitch line 22 as is used to connect the first major sidewall 15 with that peripheral edge of the peripheral gusset wall 17. In other words, the bag's interior divider wall 27 and the bag's first major sidewall 15 are both stitched along one and the same peripheral edge 28 of the peripheral gusset wall 17 by use of the same or overlying stitch lines 22, that stitched joint being interiorly of the garment bag 10 and being covered by binding tape 29. The interior divider wall 27 is made of a flexible material and, preferably, may be made of a waterproof flexible material. This, of course, permits one 25 or 26 of the two major interior compartments within the garment bag to hold wet items separate and apart from dry items that may be stored within the other 26 or 25 major compartment of the bag.

Figure 1:
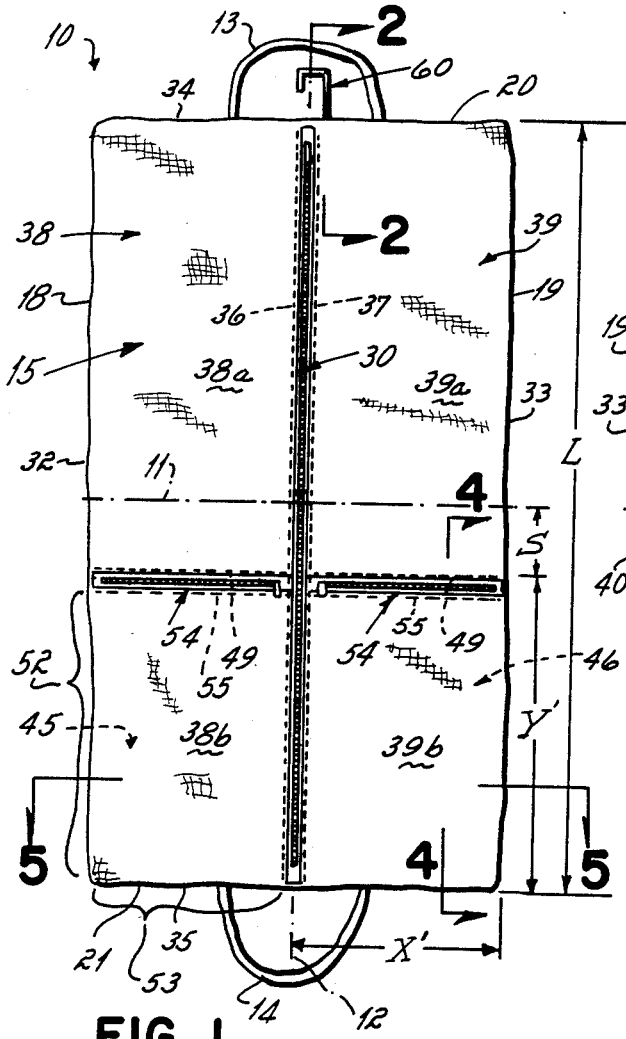
FIG. 1 is a side view illustrating one side of the hang-up garment bag in accord with the principles of this invention.

Each of the major interior compartments 25, 26 is provided with a sliding closure or fastener 30, 31, e.g., zipper, closure by which access to the compartments is achieved. FIG. 1 shows the zipper 30 closure on the first major sidewall 15, that zipper being generally parallel to and intermediate of side edges 32, 33 of the bag when it is in the hang-up position, and extending from adjacent the bag's top edge 34 to the bag's bottom edge 35. The zipper 30 is one-half each attached by stitch lines 36, 37 to the major sidewall 15 to subdivide that sidewall into opposed longitudinal panels 38, 39.

Figure 1A:
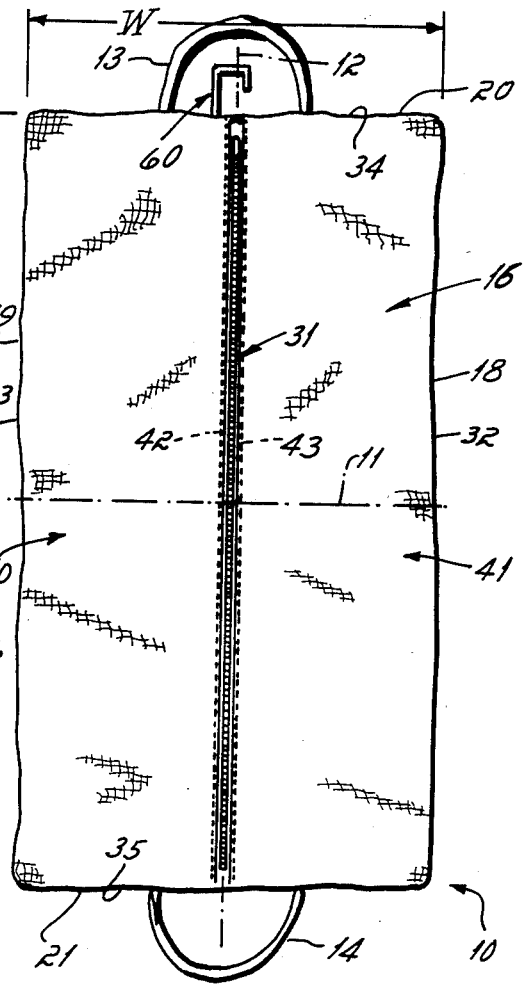
FIG. 1A is a side view similar to FIG. 1 but illustrating the other side of the hang-up garment bag.

The other major compartment 16 of the hang-up garment bag 10 is accessible through a sliding fastener or closure, i.e., zipper 31, on the second major sidewall 16. This sliding zipper closure 31 also extends between the top edge 34 and bottom edge 35 of the bag, and is generally parallel to and midway between the side edges 32, 33 of the bag, when it is in the hang-up position as shown in FIG. 1A. As with the first major sidewall 15, the zipper 31 closure divides second major sidewall 16 into longitudinal panels 40, 41 with the zipper being one-half attached to each by stitch lines 42, 43. Accordingly, access is individually provided to each of the major compartments 15, 16 in the hang-up garment bag by zippers 30, 31, but there is no access between those major compartments 15, 16 through the interior divider wall 27.

The hang-up garment bag 10 also includes two minor interior compartments 45, 46, see FIGS. 1, 4 and 5. These two minor interior compartments 45, 46 are accessible through the first major sidewall 15. Each of these minor interior compartments 45, 46 is defined by a pocket liner wall 47 interconnected with the respective longitudinal panel 38 or 39 of that major sidewall 15. The pocket liner wall 47, on its top inner end edge 48, is connected to its respective longitudinal panel 38 or 39 by stitch line 49. The pocket liner wall 47 is connected along its inner side edge 50 to that same longitudinal panel 38 or 39 by that stitch line 36 or 37 which connects the sliding fastener 30 to that respective longitudinal panel. Each pocket liner wall 47 is connected to its respective longitudinal panel 38 or 39 along its bottom end edge 50A and outer side edge 51, so as to complete definition of the minor interior compartmehts 45, 46, by those same stitch lines 22 that connect the first major sidewall 15 to the periphery 28 of the peripheral gusset wall 17. Accordingly, and along those sections 52, 53 of the gusset wall 17 connected to the first major sidewall 15 in the area of a pocket liner wall 47, the interior divider wall 27, the first major sidewall 15, and the pocket liner wall 47 are all stitched together interiorly of the hang-up garment bag 10 by stitch lines 22 as covered by a binding strip 29, see FIGS. 4 and 5. Note particularly, as shown in FIGS. 4 and 5, that each pocket liner wall 47 is of a length X and width Y greater than the length X' and width Y' of the pocket as defined on the exterior face of the first major sidewall 15. This permits each minor compartment 45, 46 to be provided with an interior depth Z sufficient to receive articles therein. Note also, as shown in FIG. 1, that the length X' of each of the minor compartments 45, 46 is substantially equal to one-half the width W of the garment bag 10, and that the width Y' of each minor compartment is somewhat less than one-half the length L of the garment bag. In other words, there is a significant space S between the phantom fold line 11 of the hang-up garment bag 10 and the top edge 48 of each minor compartment 45, 46 so that articles in the minor compartments will not hinder folding of the hang-up garment bag along that fold line for carrying purposes by the bag's user even if minor compartments are filled to capacity.

Each pocket or minor compartment 45, 46 is provided with a sliding fastener 54 along the top edge 48 thereof; the sliding fastener of one compartment 45 fixed to one longitudinal panel 38 of the bag 10 being in the same line as the sliding fastener of the compartment 46 fixed to the bag's other longitudinal panel 39 with that overall sliding fastener line being oriented generally perpendicular to the fastener line defined by the sliding fastener 30 that interconnects the two longitudinal panels to provide ingress and egress to the major compartment 25. Accordingly, access to each minor compartment 45, 46 is provided by sliding fastener 54 that has one half stitched to its respective longitudinal panel **38*a*, 39*a*, and has its other half stitched to its respective longitudinal panel 38*b*, 39*b* and the pocket liner wall 47, by stitch lines 49, 55**, respectively.

Figure 3:
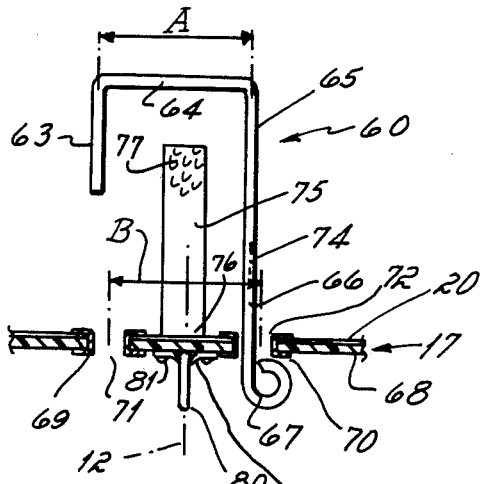
FIG. 3 is a cross-sectional view taken along lines 3—3 of FIG. 2 showing the bag's hang-up hook in extended or hang-up position.
Figure 2:
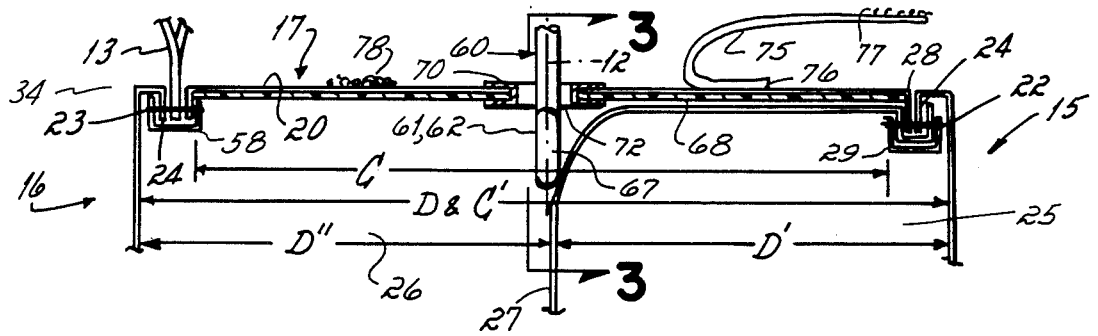
FIG. 2 is a cross-sectional view taken along lines 2—2 of FIG. 1.

The hook 60 by which the garment bag 10 can be hung up, e.g., on a closet rod or over the top edge of a door, is particularly illustrated in FIGS. 2 and 3. The hook 60 is stored in a plane 61 parallel to the general plane 62 of the garment bag. The hook 60 is extendable and retractable in a direction parallel to the longitudinal axis 12 of the garment bag 10 between a storage position, shown in FIG. 3A, and an extended or hang-up position shown in FIG. 3. The hook 60 basically comprises a nose leg 63 of short length, a base leg 64, and a connector leg 65 that form a U-shaped bag hang-up hook. A stem leg 66 extends out from and is integral with the hook's connector leg 65, and terminates in a foot 67 positioned interiorly of the bag 10. A rigid support card 68 is connected with the gusset wall 17 on the interior face of end 20 section of the gusset wall. The interconnection of the support card 68 with that end 20 section of the peripheral gusset wall 17 is established by spaced grommets 69, 70.

Figure 3A:
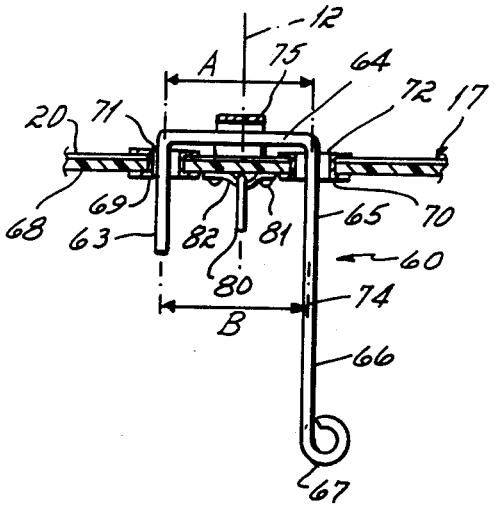
FIG. 3A is a cross-sectional view similar to FIG. 3 but illustrating the hook in retracted or storage position.

The spaced grommets 69, 70 define holes 71, 72 in gusset wall 17 that are spaced a distance A one from the other. The spacing A of the grommets 69, 70 is equal to the center line spacing B of the hook's nose leg 63 and connector leg 65/stem 66, and the interior diameter of the holes defined by the grommets is sized to permit the hook's nose leg and connector leg/stem to slide relative thereto. Accordingly, and in the extended position shown in FIG. 3, the U-shaped hook 60 is significantly removed outwardly from end 20 section of the bag's peripheral gusset wall 17, the hook being rotatable in 360° to any position desired on pivot axis 74 defined by the straight connector leg 65/stem 66. The hook 60 is held in assembled relation with the garment bag 10 when so extended, and when the bag is hung up, by virtue of the hook's interior foot 67 being sized so it cannot be pulled through grommet 70. The rigid card 68 offers suitable structural support to the garment bag 10 at the hook foot's point of contact with the grommet. In the stored position, as shown in FIG. 3A, the hook's nose leg 63 and the hook's connector leg 65/stem 66 are all received interiorly of the bag 10 so that the hook's base leg 64 overlies end 20 section of the bag's gusset wall 17. When so positioned, and as shown in FIG. 2, (when the hook is retracted to the FIG. 3A position), a latch strip 75 which is fixed to the top gusset wall 17 at one end as at 76, and provided with a male 77/female 78 type fastener that cooperates at the other end, is oriented to overlie the hook's base leg 64 so that, when the fastener 77, 78 is fastened the hook 60 is held interiorly of the bag 10.

A D-shaped hang-up hook 80, as shown in FIG. 3, is fixed to the rigid card 68 by rivets 81 and bracket 82. It is, of course, the D-shaped hang-up hook 80 that permits clothes on hangers to be hung up in major interior compartment 26 of the hang-up garment bag 10. The width C of the rigid support card 68 is preferably at least as great as the width C′ of the top section 20 of the gusset wall 17 so as to provide a frame-like element for holding the bag's sidewalls 15, 16 spaced one from the other when the bag is in its hang-up use position as shown in FIGS. 1 and 4.

As shown in FIGS. 1 and 2, a strap-like handle 13, 14 is provided on each end section 20, 21, respectively, of the peripheral gusset wall 17. Each strap-like handle 13, 14 is of a flexible material, and is attached to the sewn joint between edge 24 of the second major sidewall 16 and the edge of the peripheral gusset wall 17 by the same or additional stitch lines 23 that interconnect that peripheral gusset wall and the second major sidewall. This sewn joint is also covered by binding strip 58. When the garment bag 10 is folded along median phantom fold line 11 while carrying the bag, it is preferred that the top and bottom sections of the first major sidewall 15 be disposed in facial relation. This carrying configuration presents the handles 13, 14 juxtaposed one with the other so that the hang-up garment bag can be easily carried in folded attitude with the handles being positioned on the outer seam 23 of the folded bag since same are connected to the second major sidewall 16.

Having described my invention in detail, what I desire to claim and protect by Letters Patent is:

1. A hang-up garment bag comprising first and second major sidewalls, a peripheral gusset wall interconnecting said sidewalls, each major sidewall being joined to a peripheral edge of said gusset wall, an interior divider wall joined with said gusset wall at a peripheral edge of said gusset wall, said interior divider wall, prior to connection with said gusset wall, being of a length and width greater than the length and width of said major sidewall, that excess length and width for said interior divider wall providing interior depth to that major compartment between said interior divider wall and that major sidewall joined to the same peripheral edge of said gusset wall to which said interior divider wall is joined, thereby providing said garment bag with two major interior compartments each of which in the bag hang-up position is a length and width substantially the same as the length and width of said major sidewalls in the bag hang-up position, two pocket liner walls for providing two minor interior compartments, each of said pocket liner walls being joined partially with said gusset wall at a peripheral side edge of said gusset wall, both of said pocket liner walls having a length less than about one-half the length of said major sidewalls when said sidewalls are in the bag hang-up position, thereby providing said garment bag with two minor interior compartments each of which is of a length less than one-half the length of said major sidewalls in the bag hang-up position, and a slide fastener in each of said major sidewalls, said slide fastener providing access to said major compartments, said slide fastener separating said minor compartments along one edge thereof, and one-half of said slide fastener being connected to one edge of one minor compartment and the other half of said slide fastener being connected to one edge of said other minor compartment.

2. A hang-up garment bag as set forth in claim 1, both of said pocket liner walls being joined with said gusset wall adjacent the same end edge of said gusset wall.

3. A hang-up garment bag as set forth in claim 1, said slide fastener extending from one end edge of said gusset wall toward the other end edge of said gusset wall, each pocket liner wall being connected to a side edge and to an end edge of said gusset wall.

4. A hang-up garment bag as set forth in claim 1, said gusset wall having a top section that defines the top edge of said garment bag when it is hung up, said bag further comprising a hook connected with said top section, said hook having a generally inverted U-shaped configuration with a connector leg significantly longer than a nose leg, said connector leg serving to interconnect said hook with said top section, and structure defining two holes in said top section, one of said holes permitting said connector leg to slide therein for extending and retracting said hook between hang-up and storage positions, and the other of said holes being sized to receive said nose leg when said hook is in the storage position, thereby permitting said hook to be substantially received interiorly of said bag in said storage position.

5. A hang-up garment bag as set forth in claim 4, said nose leg and said connector leg being generally parallel one with the other, and said nose leg and said connector leg being spaced one from the other a distance substantially equal to the center line spacing of said two holes.

6. A hang-up garment bag as set forth in claim 5, said hook comprising a base leg, and bag further comprising a strap fixed to the exterior surface of said gusset wall, said strap being adapted to overlie said hook's base leg to hold said hook in said storage position.

7. A hang-up garment bag as set forth in claim 5, said gusset wall being fabricated of a flexible material, said bag comprising a rigid support card connected to said top section of said gusset wall, said rigid support card including two holes aligned with said two holes in the top section of said gusset wall.

8. A hang-up garment bag as set forth in claim 7, said bag comprising two grommets that connect said top section of said gusset wall and said rigid support card, said grommets defining said two holes for receiving said hook's nose leg and connector leg.

9. A hang-up garment bag as set forth in claim 8, said bag comprising a hanger loop fixed to said support card, said hanger loop adapted to receive clothes hangers in hang-up relation thereon.

* * * * *